United States Patent [19]

Willenbacher

[11] 4,067,275

[45] Jan. 10, 1978

[54] DEVICE FOR SEWING MACHINES FOR DISPLACING SEWN MATERIAL FOR A SHORT PERIOD OF TIME

[75] Inventor: Erich Willenbacher, Karlsruhe, Germany

[73] Assignee: Pfaff Industriemaschinen GmbH, Germany

[21] Appl. No.: 748,195

[22] Filed: Dec. 7, 1976

[30] Foreign Application Priority Data

Dec. 11, 1975 Germany ..... 7539495[U]

[51] Int. Cl.[2] ..... D05B 27/04

[52] U.S. Cl. ..... 112/212; 112/239

[58] Field of Search ..... 112/212, 210, 207, 203, 112/239, 238, 237, 235

[56] References Cited

U.S. PATENT DOCUMENTS

| | | | |
|---|---|---|---|
| 3,099,974 | 8/1963 | Chudner | 112/212 X |
| 3,437,062 | 4/1969 | Hacklander | 112/212 |
| 3,483,835 | 12/1969 | Krnac et al. | 112/212 |
| 3,540,391 | 11/1970 | Haye | 112/212 |
| 3,688,712 | 9/1972 | Edwards | 112/212 |
| 3,954,071 | 5/1976 | Mall et al. | 112/207 |

*Primary Examiner*—George H. Krizmanich
*Attorney, Agent, or Firm*—McGlew and Tuttle

[57] ABSTRACT

A device for sewing machines for displacing sewn material for a short period of time, comprises a shifting foot which is mounted on a bracket on the main frame of the sewing machine with a parallel linkage. A foot raising and lowering drive mechanism is also mounted on the frame, and it comprises a piston and cylinder combination connected to the linkage for raising the foot upwardly and downwardly. In addition, a foot shifting mechanism is supported on a plate forming a part of the linkage and it includes a piston and cylinder combination which is connected to a lever arm portion of the linkage. The connection includes a piston rod forked end having a small pin which rides in a large diameter bore of the lever arm so as to provide a lost motion for yielding of the shifting foot with the material at times. The lever arm is urged against the pin by a spring which may be adjusted along with end positions of the piston rod.

7 Claims, 11 Drawing Figures

DEVICE FOR SEWING MACHINES FOR DISPLACING SEWN MATERIAL FOR A SHORT PERIOD OF TIME

FIELD AND BACKGROUND OF THE INVENTION

This invention relates in general to the construction of sewing machines and, in particular, to a new and useful device for use with a sewing machine for displacing the sewn material for short periods of time and which includes a spring-loaded shifting foot which can be set down on the material and displaced in parallel to the feed direction.

DESCRIPTION OF THE PRIOR ART

Advance feet which are dropped onto the material by the action of a spring for supporting the feed of the sewn material are known. However, because of the inertia of the spring, this dropping takes a relatively long period of time. Consequently, during the period of time between the initiation of the dropping and the effective setting down of the foot on the material, unequally long seam lengths are sewn at unequal sewing speeds. This makes it extremely difficult to set the advance foot down on the material in a controlled manner at an exactly predetermined location during the sewing operation and, in practice, this is possible only by stopping the sewing machine at the instant of reaching that location.

In some cases, it is necessary to consider a specific point of the seam as the reference point for a subsequent positioning of the sewn material, in order to execute a further working operation at a definite location relative to this reference point, for example, while making braided openings, to cut the second corner notch into the braid strip sewn on a base material and into the base material itself. The corner notch extending from the end of the longitudinal slot of the braided opening must be cut very accurately relative to the ends of the fastening seams. Since both ends of the fastening seams must be secured against unraveling by locking seams under reversal of the feed and, for reasons of avoiding larger expenses, the length of the locking seams is controlled by an electrical timing circuit, the length of the locking seams cannot be made uniform without incurring particular control expenditures.

SUMMARY OF THE INVENTION

The present invention is directed to a device for accelerating the dropping of the shifting foot and the transfer of the sewn material always into the same selected position, independently of the length of the locking seams.

In accordance with the invention, for this purpose, an additional drive means for dropping the shifting foot, a coupling mechanism mounted in the drive connection for displacing the shifting foot and operating with an idle stroke permitting the shifting foot to give way, and a drive means for taking the shifting foot along in the feed direction into an end position which is predetermined by stops are provided.

Due to this design, the shifting foot can be abruptly set down on the sewn material at the reversal point of the seams, immediately prior to the start of the locking motion, so that an exact relative position to a specific point of the seam is fixed.

The provision of a coupling in the drive linkage operating with an idle stroke makes it possible for the sewn material to take the shifting foot along, against the action of a spring. The fixing of a definite point of the seam by the shifting foot thus remains independent of the length of the locking seams and the position defined by the stops into which the material is transferred upon completion of the locking seams always remains the same relative to the fixed seam point.

A constructionally advantageous design of the drive connection provides two parallel links which are mounted on the housing of the machine and pivoted to an intermediate plate which is connected to the shifting foot by two further parallel links of which one comprises a lever arm which is connected to the drive means for displacing the shifting foot through the coupling operating with an idle stroke. Advantageously, the drive means for dropping the shifting foot acts on one of the parallel links supporting the intermediate plate. In order to provide a mounting means for the drive mechanism for displacing the shifting foot, the intermediate plate comprises a supporting arm.

A particularly simple design of the coupling connection in the drive linkage of the shifting foot is one wherein the coupling is formed by a bore and an engaging pin, with the bore having a diameter which is a multiple of the diameter of the pin. The coupling further comprises a spring member holding the parts resiliently together.

If the sole of the shifting foot is toothed and/or provided with needles which are pointed against the material, a secure taking-along of the shifting foot by the sewn material is ensured even with smooth fabrics.

Accordingly, it is an object of the invention to provide a device for use with sewing machines for displacing sewn material for a short period of time, which comprises, a shifting foot which is mounted by a linkage adjacent the sewing machine and which includes a lifting drive means connected to the linkage to raise and lower the foot to move it into and out of engagement with the material, and a foot shifting drive means connected to the linkage to shift the foot relative to the material feed direction which includes a movable member and a lost motion connection between the movable member and the linkage for displacing the linkage with the shifting foot while permitting the foot to give way, and which further includes adjustable stop means for limiting the displacement of the foot.

A further object of the invention is to provide a device for use with sewing machines for displacing sewn material for a short period of time, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 3:
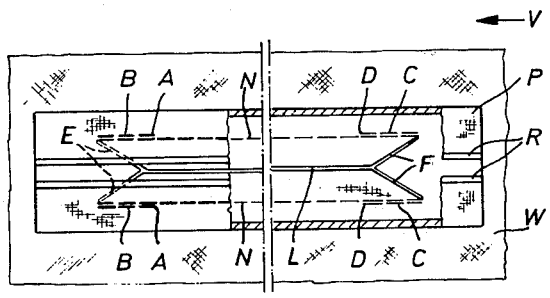
FIG. 3 is a top plan view of a cut portion of the material with a braid strip sewn thereon and having a longitudinal slot and corner incisions cut therein at the end of the longitudinal slot.

Referring to the drawing in particular, the invention embodied therein, comprises a conventional two-needle sewing machine 1, comprising a needle bar 2 which is movable up and down and carries a needle guard 3 with two spaced apart needles 4 secured thereto. Needles 4 cooperate with two rotary hooks (not shown) mounted beneath a needle plate 5, for forming two mutually independent seams N (FIG. 3). A cutting knife 6 for cutting out a longitudinal slot L of the braided opening works between needles 4 and is mounted, for movement in the longitudinal direction, on a knife bar 7 which can be coupled to a continuously driven swing lever, in a well known manner. Also mounted in the machine housing for vertical displacement is a pressure bar 8 which is resiliently biased against the material placed on needle plate 5 by the action of the usual pressure bar spring (not shown) and to which a presser foot 10 is secured by means of a screw 9. Presser foot 10 comprises two spaced apart soles 11 between which a passageway 12 is formed for the free passage of the uprighted borders R of a braid strip P which is folded into the shape of an upside down T and is to be sewn on the part of clothing. Cutting knife 6 works between borders R.

Needle plate 5 is provided with two stitch holes 13 for needles 4 and with slot 14 for the toothed webs 15 of a conventional lower feed dog of sewing machine 1 which moves in a quadrangular four-motion pattern and can be switched, by means of a known stitch guide, so that the material is shifted in the feed direction (arrow V) or in the direction opposite thereto.

At the back side of sewing machine 1, a support 16 is provided on which two parallel links 17 and 18 are mounted, each by one end, for pivoting about link studs 19 and 20. At their other ends, parallel links 17, 18 are pivoted, by means of link studs 21, 22, to an intermediate plate 23. Two further parallel links 24, 25 are pivotally mounted on intermediate plate 23, by means of link studs 26, 27, and their lower ends are pivoted, by means of link studs 28, 29, to the shank portion 30 of a shifting foot 31.

Parallel link 24 includes a lever arm portion 32, the free end of which is provided with a bore 33 through which an engaging pin 34 extends which is press-fitted in a fork head 35. The diameter of bore 33 is a multiple of the diameter of the engaging pin.

Fork head 35 is secured to the piston rod 36 of an air cylinder 37 having pressure air connections 38 and 39 for pressurizing respective ends of the cylinder to shift a piston (not shown) which is connected to the rod 36. The cylinder 37 and piston combination provides drive means for displacing shifting foot 31 in directions parallel to the feed direction indicated by arrow V. Air cylinder 37 is mounted on a supporting arm 40 of intermediate plate 23. Its piston rod 36 extends through an adjusting sleeve 41 which is screwed into the cylinder housing and serves as a stop for determining the limit of displacement of the shifting foot 31. Also secured to piston rod 36, by means of a counternut 42, is a suspension strip 43 of a tension spring 44 connecting strip 43 to lever arm 32 of parallel link 24. Tension spring 44, engaging pin 34, and bore 33, form together an elastic coupling, operating with an idle stroke, within the drive linkage for displacing shifting foot 31 in parallel to the feed direction (arrow V).

The drive means for an abrupt dropping of shifting foot 31 onto sewn material, P, W comprises an air cylinder 47 which is provided with connections 45, 46 and mounted on an angle support 48 which is secured to the housing of sewing machine 1. A fork head 50 is secured to piston rod 49 of an air cylinder 47, engages parallel link 17 and is secured and locked in position by a counternut 51, and connected to link 17 by a pin 52. A compression spring 53 is provided on piston rod 49, between counternut 51 and supporting angle 48.

Figure 1:
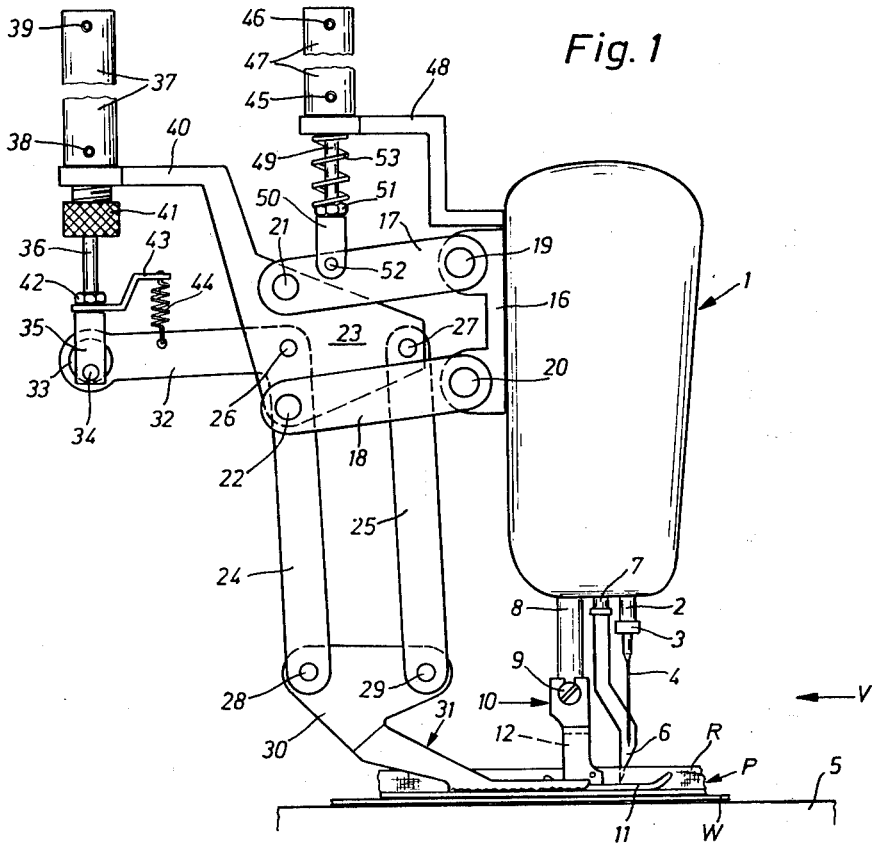
FIG. 1 is a side elevational view of a material shifting device mounted on the back side of a two-needle sewing machine, and constructed in accordance with the invention.
Figure 2:
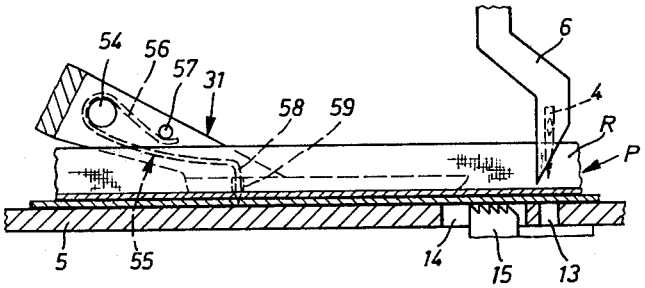
FIG. 2 is a partial enlarged sectional view of the shifting foot, needle plate and the sewn material.

In order to ensure a taking-along of shifting foot 31 by the material during the displacement thereof against the feed direction V, for locking seams N at their end, even in cases where the material is a smooth fabric, the underside of the soles of shifting foot 31 is toothed. Further, bending springs 55 engaging retaining pins 54 in shifting foot 31 are provided (only one is shown in FIG. 2), and each includes one end 56 which bears against a pin 57 secured to shifting foot 31, and another downwardly bent end has a needle-shaped end portion 58 which is biased against the material and extends through a bore 59 provided in the sole of shifting foot 31.

Sewing machine 1, the individual portions thereof, and air cylinders 37 and 47 are controlled by a conventional programmer, while using solenoid valves, in which the provided pulse generator for the instructions to be transmitted through an amplifier is a measuring wheel sensing the material and equipped with a Hall generator, which cooperates with fixed permanent magnets and is mounted, for example, on the presser bar of the sewing machine.

Assuming that a cut piece W and a braid strip P, folded to a T-shape, are placed under the lowered presser foot 10 at a location where needles 4 pierce the fabric for forming the start-end locking seams B (Location A in FIG. 3), cutting knife 6 is in a disengaged position, shifting foot 31 is lifted from material P, W, and the measuring wheel (not shown) is in contact with the material. Under this assumption, the device operates as follows:

Upon actuating a start switch, the motor driving sewing machine 1 is switched on. Starting at A, FIG. 3, first, by displacing material P, W against the feed direction indicated by arrow V, the starting locking seams B are formed, whereupon, the displacement of the material is reversed and, during this displacement, now in the direction of arrow V, seams N are formed. At a location predetermined for this purpose, cutting knife 6 working between upright borders R of braid strip P is put in operation, whereby, during the sewing process, a longitudinal slot L is cut into braid strip P and piece W. Also during the sewing operation, the corner incision E is formed by means of an angle knife (not shown) mounted below needle plate 5 of sewing machine 1. After completing slot L, cutting knife 6 is disengaged and seams N are completed up to their desired length. As soon as the end of the seam is attained, simultaneously with the switching of the stitch guide for reversing the displacement of the material (not shown), and thus for forming locking seams C, shifting foot 31, actuated by air cylinder 47, which is supplied with compressed air through connection 46, is abruptly dropped on material P, W, upon which motion, the needle-shaped ends 58 of bending springs 55, which are biased against the material, penetrate into the fabric. Thereby, a definite location is fixed relative to the end of the seam. After venting air cylinder 47, shifting foot 31 continues to be pressed against the material by compression spring 53 which is provided in the drive connection for dropping shifting foot 31. During the displacement of the material against the feed direction (arrow V) which follows, i.e., for forming locking seams G, shifting foot 31 is taken along by the material up to the end of the seam at D, FIG. 3, whereby, tension spring 44 is stretched. The taking along of shifting foot 31 by the material is made possible by the provision that the diameter of bore 33 in lever arm portion 32 of parallel link 24 is substantially larger than the diameter of pin 34 which is fixed in fork head 35 and extends through bore 33.

During the last upward motion of needle bar 2, the threads are cut off, presser foot 10 is lifted from the material, and sewing machine 1 is stopped in the top position of the needles. By loading the piston of air cylinder 37 through connection 38, parallel link 24 is pivoted about stud 26 of intermediate plate 23 until counternut 42, which is carried on piston rod 36 of air cylinder 37, butts against adjusting sleeve 41. Due to the provision of the other link 25 between plate 23 and shank portion 30 of shifting foot 31, upon actuating link 24, a parallel displacement of shifting foot 31 with the material in the feed direction V is obtained whereby, the material is shifted always into the same position as determined by the adjusting sleeve 41 and counternut 42, independently of the length of the end locking seams C.

In the example shown, this relative position is variable by means of the sleeve 41 which is used for positioning the material above the angle knife mounted below needle plate 5. This adjustment may be so accurate that the diverging corner incision F will extend exactly from the end of longitudinal slot L to the end of seams N. This accurate position of the cut substantially contributes to the good aspect of the finished braided opening after turning the work inside out.

As soon as the corner incision F is made, shifting foot 31 and, thereby, the material, is displaced, by supplying compressed air through connection 39 into air cylinder 37, against the feed direction V, thus toward the operator, and then lifted from the material, by supplying compressed air through connection 45 into air cylinder 47, so that the finished workpiece can be removed from the sewing table. Upon putting another cut W and a braid strip, folded to the shape of an inverted T into place, and after lowering presser foot 10, another operational cycle can be started.

While a specific embodiment of the invention has been shown and described in detail to illustrate the application of the principles of the invention, it will be understood that the invention may be embodied otherwise without departing from such principles.

What is claimed is:

1. A device for displacing sewn material for use with a sewing machine, comprising a shifting foot, a linkage connected to said foot, means for supporting said linkage adjacent the sewing machine, foot lifting drive means connected to said linkage to raise and lower said foot to move it out of and into engagement with the material, foot shifting drive means connected to said linkage to shift said foot relative to the material feed direction, said foot shifting drive means including a movable member, a lost motion connection between said movable member and said linkage for displacing said linkage with said shifting foot while permitting said foot to give way and adjustable stop means for limiting the displacement of said shifting foot.

2. A device for displacing sewn material for use with a sewing machine, according to claim 1, wherein said means for supporting said linkage comprises a bracket mounted on the sewing machine, first and second parallel links mounted on said bracket, an intermediate plate pivotally connected to said first and second parallel links and supporting said foot shifting drive means, third and fourth parallel links connected pivotally at their one ends to said shifting foot and at their opposite end to said plate, said third parallel link including a lever arm portion connected to said shifting foot drive means for displacing the shifting foot.

3. A device for displacing sewn material for use with a sewing machine, according to claim 2, wherein said lifting drive means is connected to said first parallel link.

4. A device for displacing sewn material for use with a sewing machine, according to claim 2, wherein said intermediate plate comprises an arm portion supporting said lifting drive means.

5. A device for displacing sewn material for use with a sewing machine, according to claim 3, wherein said shifting drive means movable member comprises a rod having an engaging pin, said linkage arm portion having a bore substantially larger than said engaging pin into which said pin extends for transmitting motion to said lever arm and said shifting foot.

6. A device for displacing sewn material for use with a sewing machine, according to claim 5, including a spring member urging said lever arm portion into engagement with said pin.

7. A device for displacing sewn material for use with a sewing machine, according to claim 1, wherein said shifting foot includes an undersurface having a toothed formation for facilitating engagement thereof and a needle carried by said shifting foot for engagement in the material.

* * * * *